US009413059B2

(12) United States Patent
Bayram et al.

(10) Patent No.: US 9,413,059 B2
(45) Date of Patent: Aug. 9, 2016

(54) ADAPTIVE ANTENNA FEEDING AND METHOD FOR OPTIMIZING THE DESIGN THEREOF

(71) Applicant: PaneraTech, Inc., Chantilly, VA (US)

(72) Inventors: Yakup Bayram, Falls Church, VA (US); Wladimiro Villarroel, Lewis Center, OH (US); Alexander Ruege, Centerville, VA (US); Eric Walton, Columbus, OH (US)

(73) Assignee: PANERATECH, INC., Chantilly, VA (US)

( * ) Notice: Subject to any disclaimer, the term of this patent is extended or adjusted under 35 U.S.C. 154(b) by 90 days.

(21) Appl. No.: 14/275,157

(22) Filed: May 12, 2014

(65) Prior Publication Data

US 2014/0340279 A1 Nov. 20, 2014

Related U.S. Application Data

(60) Provisional application No. 61/823,223, filed on May 14, 2013.

(51) Int. Cl.

| | |
|---|---|
| ***H01Q 1/24*** | (2006.01) |
| ***H01Q 1/32*** | (2006.01) |
| ***H01Q 1/12*** | (2006.01) |
| ***H01Q 9/40*** | (2006.01) |
| ***H01Q 21/28*** | (2006.01) |

(52) U.S. Cl.

CPC ..... *H01Q 1/248* (2013.01); *H01Q 1/1271* (2013.01); *H01Q 1/24* (2013.01); *H01Q 1/242* (2013.01); *H01Q 1/32* (2013.01); *H01Q 9/40* (2013.01); *H01Q 21/28* (2013.01)

(58) Field of Classification Search

CPC ..... H01Q 1/24; H01Q 1/242; H01Q 1/1271; H01Q 1/50; H01Q 1/32; H01Q 21/28; H01Q 1/271

USPC ..... 343/700 MS, 702, 713

See application file for complete search history.

(56) References Cited

U.S. PATENT DOCUMENTS

| | | | | |
|---|---|---|---|---|
| 5,872,542 | A * | 2/1999 | Simons | H01Q 1/1271 343/700 MS |
| 6,384,790 | B2 | 5/2002 | Dishart et al. | |
| 7,205,947 | B2 | 4/2007 | Parsche | |
| 7,233,296 | B2 | 6/2007 | Song et al. | |

(Continued)

FOREIGN PATENT DOCUMENTS

| | | |
|---|---|---|
| WO | 2005/086277 | 9/2005 |
| WO | WO 2013/149514 | 10/2013 |

*Primary Examiner* — Hoang V Nguyen

(74) *Attorney, Agent, or Firm* — Whiteford, Taylor & Preston, LLP; Gregory M. Stone

(57) ABSTRACT

Disclosed is an antenna feeding system and method to optimize the design of the feeding system to feed an antenna made of a resistive sheet. The system and method are operative to design a topology of the antenna feeding system to adapt to a topology of the resistive sheet antenna to mitigate the adverse effects caused by the inherent losses of resistive sheets while operating as antennas. The system is designed to reduce a convergence of radiofrequency currents that may create a localized high density current concentration, such as "hot spots" and "pinch points," on the resistive sheet, by a sufficient extent so as to prevent power losses that substantially decrease the radiation efficiency of the antenna as compared with feeding systems designed using traditional design techniques.

18 Claims, 8 Drawing Sheets

(56) References Cited

U.S. PATENT DOCUMENTS

| | | | | |
|---|---|---|---|---|
| 7,427,961 | B2 | 9/2008 | Song et al. | |
| 7,675,466 | B2 | 3/2010 | Gaucher et al. | |
| 7,983,721 | B2 | 7/2011 | Ding et al. | |
| 8,279,131 | B2 * | 10/2012 | Puzella | H01Q 1/02 343/700 MS |
| 8,299,967 | B2 | 10/2012 | Xu et al. | |
| 8,424,769 | B2 | 4/2013 | Kato | |
| 8,634,764 | B2 * | 1/2014 | Cruz | H01Q 1/007 343/700 MS |
| 8,749,438 | B2 | 6/2014 | Jenwatanavet et al. | |
| 8,766,856 | B2 | 7/2014 | Hsieh et al. | |
| 2002/0152606 | A1 | 10/2002 | Huang | |
| 2006/0009251 | A1 * | 1/2006 | Noda | H01Q 1/22 455/550.1 |
| 2007/0040746 | A1 | 2/2007 | Song et al. | |
| 2007/0287503 | A1 | 12/2007 | Ying et al. | |
| 2009/0267839 | A1 | 10/2009 | Liao et al. | |
| 2011/0156967 | A1 | 6/2011 | Oh et al. | |
| 2011/0273382 | A1 | 11/2011 | Yoo et al. | |
| 2012/0133597 | A1 | 5/2012 | Chen | |
| 2012/0162032 | A1 | 6/2012 | Yang et al. | |
| 2012/0287066 | A1 | 11/2012 | Yang et al. | |
| 2013/0059532 | A1 | 3/2013 | Mahanfar et al. | |
| 2014/0139379 | A1 * | 5/2014 | Bolin | H01Q 9/06 343/702 |
| 2014/0176819 | A1 | 6/2014 | Yilmaz | |

* cited by examiner

ADAPTIVE ANTENNA FEEDING AND METHOD FOR OPTIMIZING THE DESIGN THEREOF

CROSS REFERENCE TO RELATED APPLICATION

This application is based upon and claims priority from co-pending U.S. Provisional Patent Application Ser. No. 61/823,223 entitled "PLANAR ANTENNA SYSTEM" filed with the U.S. Patent and Trademark Office on May 14, 2013, by the inventors herein, the specification of which is incorporated herein by reference.

FIELD OF THE INVENTION

The present invention relates to antenna systems and methods. More particularly, the present invention relates to antenna feeding systems to feed antennas made of resistive materials and antenna feeding design and manufacturing methods for overcoming adverse effects caused by losses in such resistive materials.

BACKGROUND OF THE INVENTION

A number of resistive sheet or resistive layer antenna designs and systems exist within various industries for providing a partly conductive and at the same time optically transparent layer of material for multiple applications. An antenna feeding mechanism is associated with each of these antenna systems. The sheet resistivity and the light transparency of the resistive sheet are the key factors that determine the implementation of a resistive sheet antenna. In general, an antenna made of a resistive transparent sheet, such as Indium tin oxide, experience losses several orders of magnitude larger than an antenna made of a conductive material such as copper or silver. Therefore, antennas are primarily made of a conductive material, if possible. However, conductive materials are opaque to light. As a result, in certain applications requiring the use of a transparent antenna, a conductive material cannot be used.

In recent years, the demand for transparent antennas has increasingly grown for touchscreen, mobile platform, and automobile applications. In particular, the implementation of antennas, made of a transparent conductive layer, on the display window of a portable communication device have been addressed in the prior art, as described in U.S. Pat. No. 7,983,721 to Ding et al., the specification of which is incorporated herein by reference in its entirety. However, these efforts have faced certain challenges and limitations. Particularly, attempts made to provide an antenna design sufficiently transparent to light and at the same time capable of performing at radiation efficiency levels set up by industry standards have not been successful. A major challenge is that as the sheet resistivity of a resistive sheet decreases, making the resistive sheet more conductive, the optical transparency of the resistive sheet decreases. Likewise, as the sheet resistivity increases, the power dissipated as heat as a result of currents flowing on the resistive sheet increases too. Accordingly, the radiated power and the radiation efficiency of the resistive sheet are reduced, making it very challenging for resistive sheet antennas to meet radiation efficiency industry standards.

As a result, a compromise is required between two conflicting goals. Firstly, making the resistive sheet as conductive as possible, which means less transparent; and secondly, making the antenna more optically transparent, which means a more resistive sheet having a larger sheet resistivity. Current technology offers optically transparent resistive sheets having a sheet resistivity larger than 10 Ohms per square. However, for these values of sheet resistivity, standard design techniques used for antennas made of conductive materials notably fail.

The antenna feeding mechanism plays a crucial role in the overall radiation efficiency of the feeding-antenna system. Typically, standard feeding design techniques will enable the excitation of radiofrequency (RF) currents on the resistive sheet antenna at the expense of significant power losses. Two key reasons account for these losses: first, usually there are large concentrations of RF currents on the resistive sheet at the transitioning area between the transmission line used to feed the antenna and the resistive sheet antenna; and second, the non-uniform distribution of RF current densities excited on the resistive sheet. In general, the amount of power losses significantly increases as the sheet resistivity increases.

Moreover, in placing an antenna or a feeding mechanism close to conductive or resistive materials, electromagnetic coupling between the antenna and these materials also contributes to power losses that decrease the effective radiated power at a system level. In most touchscreen and mobile platform applications, the antenna-feeding system is surrounded by a number of conductive and resistive materials that must be considered, especially when designing an antenna using resistive sheets, to maximize the overall radiated power. Accordingly, manufacturers intending to use a resistive sheet on the touchscreen area as an antenna experience either an unacceptable reduction in radiation efficiency or an unacceptable performance of the touchscreen. This leads manufacturers to implementation of antenna systems that are costly, aesthetically unappealing, or more importantly, highly inefficient.

Previous efforts have been made to develop a method of improving the radiation efficiency of antennas made of transparent resistive sheet, as described in U.S. Pat. No. 7,233,296 to Song, et al., the specification of which is incorporated herein by reference in its entirety. However, this method is primarily aimed at determining values for current density over the surface of the resistive sheet to identify regions having concentrated flow of currents. Then the antenna efficiency is improved by increasing the conductivity in such areas of high current concentration.

The method described in the patent to Song et al., has also faced severe challenges and limitations. In particular, the resulting resistive layer will not be optically homogeneous. In other words, there will be areas of the resistive layer having darker spots resulting from the increased conductivity. Thus, although the resistive layers may meet optical transparency functional requirements, the resistive layer will not be aesthetically appealing. Furthermore, the manufacturing process used to provide different regions with different conductivity increases costs. Moreover, and more importantly, the areas of high-current concentration will vary depending on the type of application, the user operation, and the surrounding areas to the resistive sheet. Accordingly, small areas of higher conductivity on the resistive sheet may not cover a shift of the high-current spots. Alternatively, increasing the size of the areas of higher conductivity (darker areas) on the resistive sheet may further compromise the aesthetics and the optical transparency of the resistive sheet.

Furthermore, Bayram et al., as described in copending and co-owned U.S. patent application Ser. No. 14/252,975 titled "Antenna and Method for Optimizing the Design Thereof" (the specification of which is incorporated herein by reference in its entirety), have disclosed an approach for improving the radiation efficiency of a resistive sheet antenna, based on the topology design of the resistive sheet. In this approach, the radiation efficiency of the antenna is primarily increased by either reducing or preventing RF current "hot spots" and "pinch points" flowing on the resistive sheet. While this approach is effective in reducing or preventing high concentrations of RF currents, once they are flowing on the resistive sheet, a major limitation may result where the feeding mechanism is based on standard feeding designs. As a result, this approach is not able to prevent the non-uniform distribution of RF current densities and large concentrations of RF currents on the resistive sheet at the transitioning area between the transmission line used to feed the antenna and the resistive sheet antenna. Thus, even if the radiation efficiency of the antenna is improved, the power losses at the feeding transitioning area may result in an overall efficiency of the feeding-antenna system that is unacceptable to meet industry standards.

An RF current "hot spot" is characterized by a region of a material wherein a concentration of RF current is present having significantly larger current levels as compared to other regions having a more uniform current distribution and lower current levels. In particular, for a resistive sheet, a "hot spot" region dissipates a substantial amount of power as heat, significantly reducing the amount of radiated power.

Likewise, an RF current "pinch point" is characterized by a region of a material wherein the physical configuration of the material forces the RF current to converge creating high concentration of current levels. Thus, a narrow region of a material will have larger current densities as compared to a wider region of the same material. Accordingly, a "pinch point" in a resistive material will result in a substantial amount of power dissipated as heat, significantly reducing the amount of radiated power. Therefore, for a resistive sheet to be able to radiate power and operate as an antenna, it is as critical to avoid RF current "hot spots" and "pinch points" at both the feeding transitioning area and on the resistive sheet.

A way to address the disadvantages of the efforts attempted by the prior art is to design a feeding mechanism adapted to the topology of the resistive sheet antenna. This would make it possible to increase the radiation efficiency of the overall feeding-antenna system by identifying and mitigating or eliminating the sources of losses experienced both at the feeding transitioning area and as current flows on the resistive sheet. In particular, a feeding topology may be designed to uniformly distribute RF currents on the topology of the resistive sheet that prevent RF current "hot spots" and "pinch points," resulting in substantial increase of radiation efficiency.

Currently, there is no well-established method of deterministically creating a topology configuration of a feeding mechanism that adapts to the topology of a resistive sheet antenna, to optimize the radiation efficiency of the feeding-antenna system, especially for resistive sheets having a sheet resistivity greater than 10 Ohms per square.

Thus, there remains a need in the art for antenna feeding systems and methods to feed resistive sheet antennas that are capable of operating at radiation efficiencies that avoid the problems of prior art systems and methods.

SUMMARY OF THE INVENTION

An antenna feeding system and method of optimizing the design of the feeding system to feed an antenna made of a resistive sheet, or equivalently a resistive layer, is disclosed herein. One or more aspects of exemplary embodiments provide advantages while avoiding disadvantages of the prior art. The system and method are operative to design a topology of the antenna feeding system to adapt to a topology of the resistive sheet antenna to mitigate the adverse effects caused by the inherent losses of resistive sheets while operating as antennas. The system is designed to reduce a convergence of RF currents that may create a localized high density current concentration, such as "hot spots" and "pinch points," on the resistive sheet, by a sufficient extent so as to prevent power losses that substantially decrease the radiation efficiency of the antenna as compared with antennas using feeding systems designed following traditional design techniques.

The overall radiation efficiency of the resistive sheet antenna-feeding system depends not only on the topology of the resistive sheet antenna but also on how efficiently the feeding system is able to excite RF currents on the antenna. An antenna feeding system designed according to the method described herein is able to uniformly distribute the currents that flow from the feeding system into the resistive sheet antenna, reducing the power dissipated as heat. Accordingly, more power is radiated by the resistive sheet, improving the radiation efficiency of the antenna.

An antenna topology that provides wide areas and smooth edges wherein current flows to yield a more uniform current density distribution, by preventing localized high density current concentration, on the resistive sheet may result in a substantially higher antenna radiation efficiency. In particular, wide areas of the resistive sheet contribute to prevent RF current "pinch points," while smooth edges contribute to avoid RF current "hot spots," especially at contracted, corner, junction, bend, peripheral, or sharp regions of said resistive sheet, where significant RF power is dissipated as heat instead of being radiated.

Therefore, to substantially increase the radiation efficiency of the resistive sheet antenna-feeding system, it is critical for the antenna feeding system to meet two requirements: first, to be able to excite RF currents that flow uniformly distributed on the resistive sheet; and second, to prevent localized high current density concentrations at the feeding area. An antenna feeding system designed according to the method described herein is able to meet these two requirements by adapting the topology of the feeding system to that of the resistive sheet antenna. In addition, this topology adaptation may take into consideration the input impedance matching between the antenna and the transmission line feeding the antenna, which is also a key factor impacting the radiation efficiency of any antenna.

The determination of the topology configuration of the antenna feeding system is based on the physical dimensions of the design of the resistive sheet antenna. Specifically, the area of the antenna feeding system in which the RF currents flow, to be able to excite the resistive sheet, is disposed such that said area is within a contour defined by the periphery of the topology of the resistive sheet antenna. In addition, the topology of the feeding system provides wide areas and smooth edges to prevent "hot spots" and "pinch points" on the resistive sheet at the feeding area. Moreover, the topology of the feeding system transitions into the specific transmission line feeding the antenna to provide a proper impedance matching.

The method to design an adaptive feeding system to feed a resistive sheet antenna that results in a significantly higher radiation efficiency as compared to standard techniques includes the step of determining an initial topology of the antenna feeding system having an area, in which the RF currents flow, that is smaller than the area defined by the periphery of the topology of the resistive sheet antenna. The method further includes the steps of coupling the antenna feeding to the resistive sheet antenna and adapting the initial topology of the antenna feeding, through alternative topology designs, to enable the excitation of RF currents that flow as uniformly as possible over the resistive sheet antenna, reducing RF current "hot spots" and RF current "pinch points." The method further includes the step of selecting the feeding transitioning topology most suitable to the transmission line to be used for the intended application of said antenna, in terms of performance or other predetermined criteria.

By significantly reducing the losses caused by currents flowing over a resistive sheet by means of determining a suitable topology of the antenna feeding system and by increasing the uniform distribution of the current density flowing on the resistive sheet, the adaptive antenna feeding system and method are able to provide outcomes that significantly increase the radiation efficiency of the resistive sheet antenna-feeding system, as compared to designs using standard techniques. This increase in radiation efficiency may be multiple times larger, resulting in designs that meet or exceed challenging industry standards, in terms of antenna radiation performance and optical transparency, for a resistive sheet antenna.

BRIEF DESCRIPTION OF THE DRAWINGS

The numerous advantages of the present invention may be better understood by those skilled in the art by reference to the accompanying drawings in which.

DESCRIPTION

The following description is of one or more aspects of the invention, set out to enable one to practice an implementation of the invention, and is not intended to any specific embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
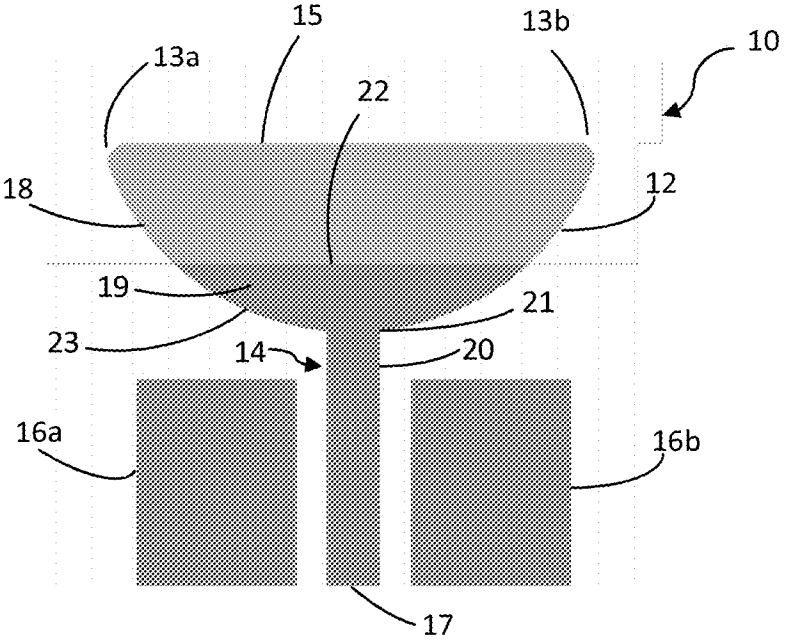
FIG. 1 shows an exemplary embodiment of a planar, semi-elliptical adaptive feeding system used to feed a semi-elliptical resistive sheet antenna.

FIG. 1 shows an exemplary configuration of an antenna-feeding system 10, in accordance with aspects of an embodiment of the invention, comprising a planar antenna element 12, a coplanar waveguide 14, and a feeding coupling element 19. Antenna element 12 comprises a resistive layer, consisting of an Indium tin oxide-based film. The topology of antenna element 12 has a semi-elliptical configuration, comprising a first edge 15, primarily having a linear shape, and a second edge 18, having an elliptical shape. Second edge 18 is elliptically shaped according to an ellipse with a major axis of 20 mm, parallel to first edge 15, and a major-to-minor axes ratio of 1.05. Accordingly, first edge 15 and second edge 18 join at two regions defining corners 13*a* and 13*b* of antenna element 12. Moreover, each corner 13*a*, 13*b* of antenna element 12 is shaped to follow an elliptical shape according to an ellipse of major axis 2.2 mm and a major-to-minor axes ratio of 1.05.

Coplanar waveguide 14 is implemented by means of a thin layer of conductive feed line 20 and a ground plane structure formed by two thin layers of 8-mm wide by 13-mm long rectangular sections made of conductive material, 16*a* and 16*b*, disposed on each side of feed line 20 at a distance of about 1.1 mm from feed line 20. Conductive feed line 20 has a rectangular shape, having a width of approximately 3 mm and a length of about 15 mm, and comprises a first end 17 opposite antenna element 12 and a second end 21 proximate to antenna element 12. Conductive feed line 20 transitions into feeding coupling element 19 at second end 21, wherein antenna element 12 adjoins feed line 20 of coplanar waveguide 14.

Ground plane sections 16*a* and 16*b* are disposed coplanar with and generally parallel to feed line 20 of coplanar waveguide 14.

First end 17 of feed line 20 is electrically connected, directly or indirectly, to a receiver (not shown) or a transmitter (not shown). Also, first end 17 of feed line 20 is aligned with each end of ground plane sections 16*a* and 16*b* opposing second end 21 of feed line 20. Therefore, feed line 20 extends by 2 mm from each end of ground plane sections 16*a* and 16*b* proximate to second end 21 of feed line 20. In other words, there is a gap of at least 2 mm between ground plane sections 16*a* and 16*b* and antenna element 12.

Second end 21 of feed line 20 is electrically connected to feeding coupling element 19. Feeding coupling element 19 transitions the feeding mechanism of antenna element 12 from a rectangular configuration of second end 21 of feed line 20 to a semielliptical configuration to adapt to the topology of antenna element 12. Thus, the topology of feeding coupling element 19 has a semi-elliptical configuration, comprising a first edge 22, primarily having a linear shape, and a second edge 23, having an elliptical shape. Second edge 23 of feeding coupling element 19 is elliptically shaped according to the topology of antenna element 12 following an ellipse with a major axis of 20 mm and a major-to-minor axes ratio of 1.15.

An area within the peripheral boundary defined by the topology of antenna element 12 fully overlaps with an area within the peripheral boundary defined by the topology of feeding coupling element 19. In general, the area defined by feeding coupling element 19 is smaller than the area defined by antenna element 12 such that second end 21 is within the peripheral boundary of antenna element 12. In the configuration shown in FIG. 1, feeding coupling element 19 extends 1 mm from second end 21 of feeding line 20 into antenna element 12. Feeding coupling element 19 physically and electrically couples with antenna element 12. Antenna element 12 attaches to feeding coupling element 19 over the overlapping region by means of a conductive adhesive. Alternatively, feeding coupling element 19 may electromagnetically couple, i.e., connect capacitively or inductively, to antenna element 12. Furthermore, feeding coupling element 19 may attach to antenna element 12 by means of soldering or any other conductive material.

In particular, feeding coupling element 19 is designed adaptively to the topology of antenna element 12 to smoothly transition RF currents carried by feed line 20 into antenna element 12 or carried by antenna element 12 into feed line 20. Likewise, the adaptive design of feeding coupling element 19 enables a more uniform flow of RF currents over as much area as possible of antenna element 12, while preventing RF current "pinch points" or "hot spots," within the limitations of an intended application for antenna-feeding system 10. As a result a significantly higher antenna radiation efficiency may be achieved as compared to antenna-feeding systems using standard feeding designs.

Those skilled in the art will recognize that antenna element 12 and coplanar waveguide 14 may be disposed coplanar or non-coplanar either on the same or different rigid or flexible substrates. Similarly, ground plane sections 16*a* and 16*b* of coplanar waveguide 14 may have different shapes and dimensions. Also, the topology of antenna element 12 may take on a geometrical configuration other than semi-elliptical. Correspondingly, feeding coupling element 19 may be configured to adapt to the topology of antenna element 12.

Likewise, those skilled in the art will realize that in instances wherein RF currents are of negligible value in a region or regions of antenna element 12 or feeding coupling element 19, feeding coupling element 19 does not need to be designed adaptively to the topology of antenna element 12 to smoothly transition RF currents carried by feed line 20 into antenna element 12 or carried by antenna element 12 into feed line 20. In these instances, the region or regions of antenna element 12 or feeding coupling element 19 wherein RF currents are of negligible value can be removed without affecting performance of antenna system 10.

Figure 2:
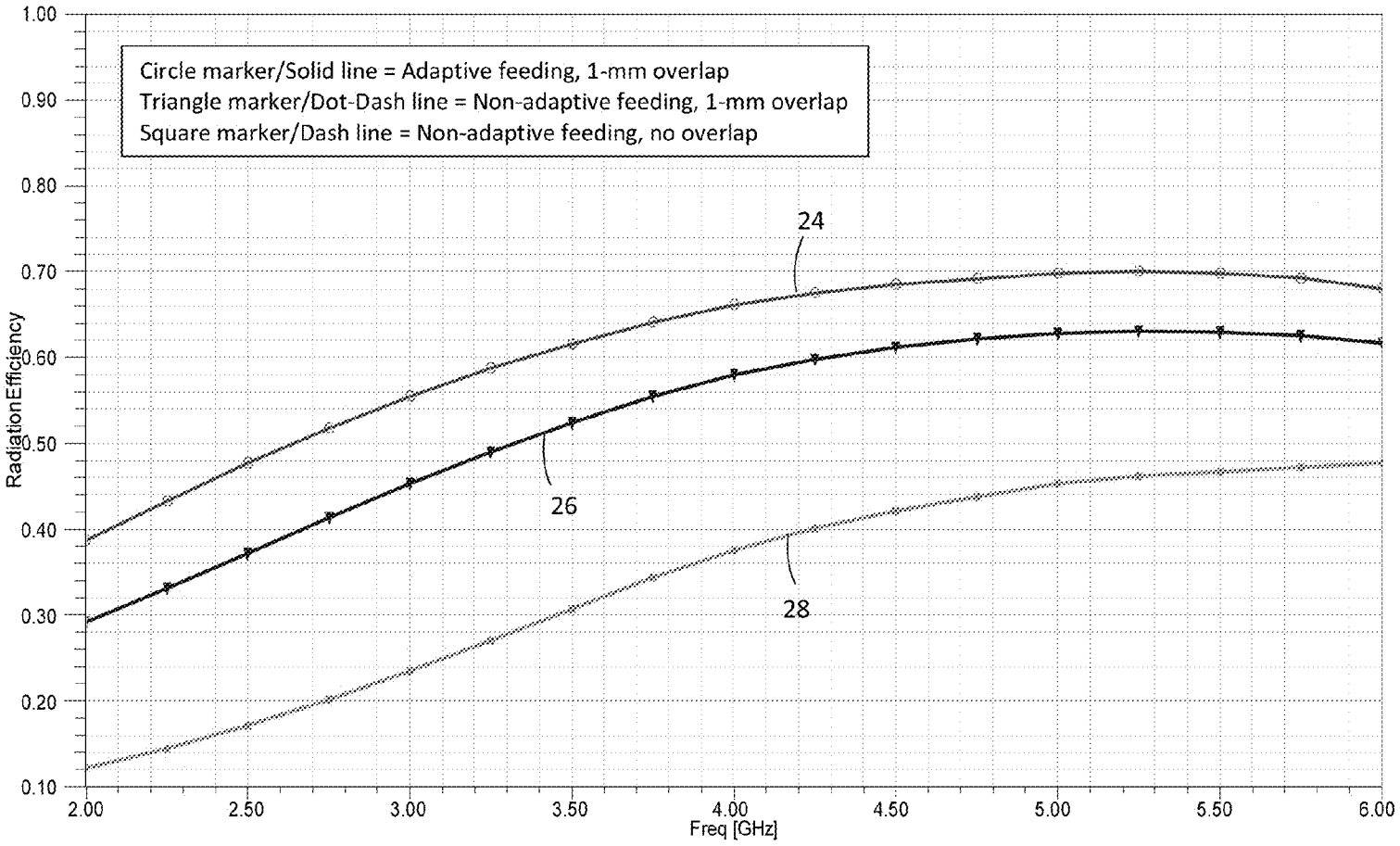
FIG. 2 shows a graph of antenna radiation efficiency, as a function of frequency, of a resistive sheet antenna having a 25 Ohm per square sheet resistivity for different feeding mechanisms.

FIG. 2 shows a graph of antenna radiation efficiency, as a function of frequency, calculated by a well-known and commercially available electromagnetic software (Ansys-HFSS), corresponding to the configuration shown in FIG. 1, wherein antenna element 12 is made of a resistive sheet having a 25 Ohm per square sheet resistivity, for three different feeding mechanisms. Coplanar waveguide 14 and antenna element 12 are both disposed on top of a 280×174 mm glass substrate of 0.55-mm thickness, having a relative permittivity of 7 and a loss tangent of 0.01. In this configuration, antenna-feeding system 10 is intended to operate at a frequency of approximately 5.25 GHz.

The results of a first feeding mechanism, corresponding to feeding coupling element 19 adapted to the topology of antenna element 12, are shown in curve 24, represented in FIG. 2 by a solid line with a circle marker. These results show that at 5.25 GHz frequency, the radiation efficiency of antenna-feeding system 10 is about 70%.

The results of a second feeding mechanism, corresponding to a feeding coupling element overlapping, but not adapted, to the topology of antenna element 12, are shown in curve 26, represented in FIG. 2 by a dot-dashed line with a triangle marker. These results show that at 5.25 GHz frequency, the radiation efficiency of antenna-feeding system 10 is approximately 63%. In this configuration, the feeding coupling element has the same rectangular shape as feed line 20, and acts as an extension of feed line 20, overlapping by 1 mm into antenna element 12. These results show that at 5.25 GHz frequency, the radiation efficiency of the antenna-feeding system is approximately 63%.

The results of a third feeding mechanism, corresponding to a feed line 20 physically touching and electrically connected to second edge 18 of antenna element 12, are shown in curve 28, represented in FIG. 2 by a dashed line with a square marker. In this configuration, there is no feeding coupling element overlapping or adapted to the topology of antenna element 12. These results show that at 5.25 GHz frequency, the radiation efficiency of the antenna-feeding system is approximately 46%. This configuration is representative of traditional design techniques to feed an antenna.

The results shown in FIG. 2 are indicative that an adaptive feeding coupling element 19, overlapping antenna element 12, results in a significantly higher radiation efficiency of resistive antenna-feeding system 10, as compared to traditional feeding design techniques.

Figure 3:
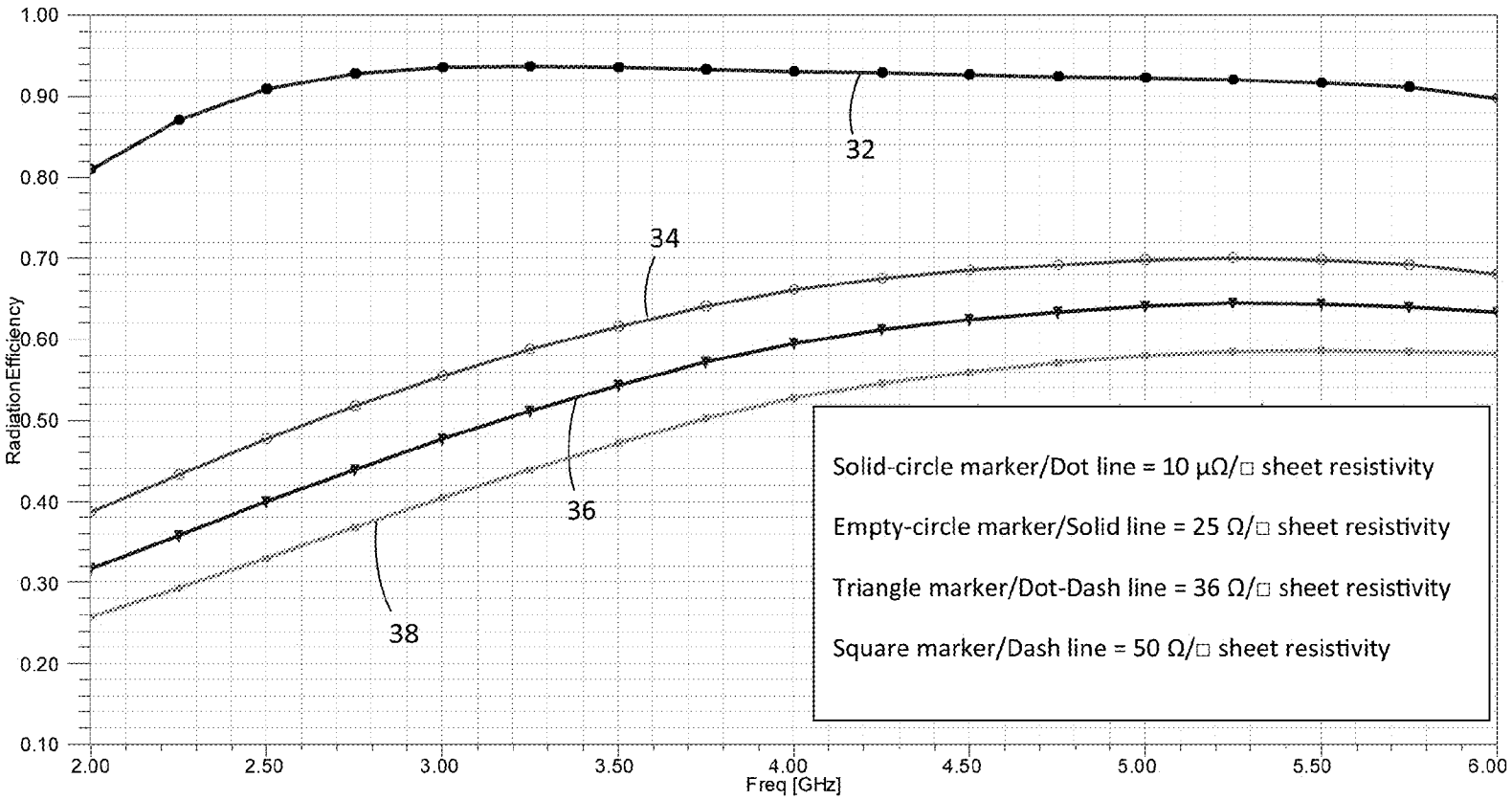
FIG. 3 shows a graph of antenna radiation efficiency, as a function of frequency, of a resistive sheet antenna having an adaptive feeding antenna system for different values of sheet resistivity.

FIG. 3 shows a graph of antenna radiation efficiency, as a function of frequency, calculated by a well-known and commercially available electromagnetic software (Ansys-HFSS), corresponding to the configuration shown in FIG. 1, wherein antenna element 12 is made of a resistive sheet, for different values of sheet resistivity. Coplanar waveguide 14 and antenna element 12 are both disposed on top of a 280×174 mm glass substrate of 0.55-mm thickness, having a relative permittivity of 7 and a loss tangent of 0.01. In this configuration, antenna-feeding system 10 is intended to operate at a frequency of approximately 5.25 GHz.

Particularly with reference to FIG. 3, a dotted line with a solid-circle marker curve 32; a solid line with an empty-circle marker curve 34; a dot-dashed line with a triangle marker curve 36; and a dashed line with a square marker curve 38, correspond to the simulated radiation efficiency of antenna-feeding system 10 made of a material having a 10 μOhm per square sheet resistivity, a 25-Ohm per square sheet resistivity, a 36-Ohm per square sheet resistivity, and a 50-Ohm per square sheet resistivity, respectively. This graph shows how the radiation efficiency of antenna system 10 increases as the sheet resistivity decreases. Also, FIG. 3 shows that the radiation efficiency of antenna system 10 is significantly larger (above 80%) when a material having a sheet resistivity of 10 μOhm per square is used. This value of sheet resistivity is common for highly conductive materials, such as copper and silver, at the range of frequency values indicated in FIG. 3. However, for certain applications, including those involving tablets, laptop computers or mobile phones, the use of a resistive sheet material of up to 50-Ohm per square sheet resistivity is required or preferred over the use of a highly conductive material. In these cases, the use of antenna-feeding systems with improved radiation efficiency may be the only way to practically implement a solution.

Figure 4:
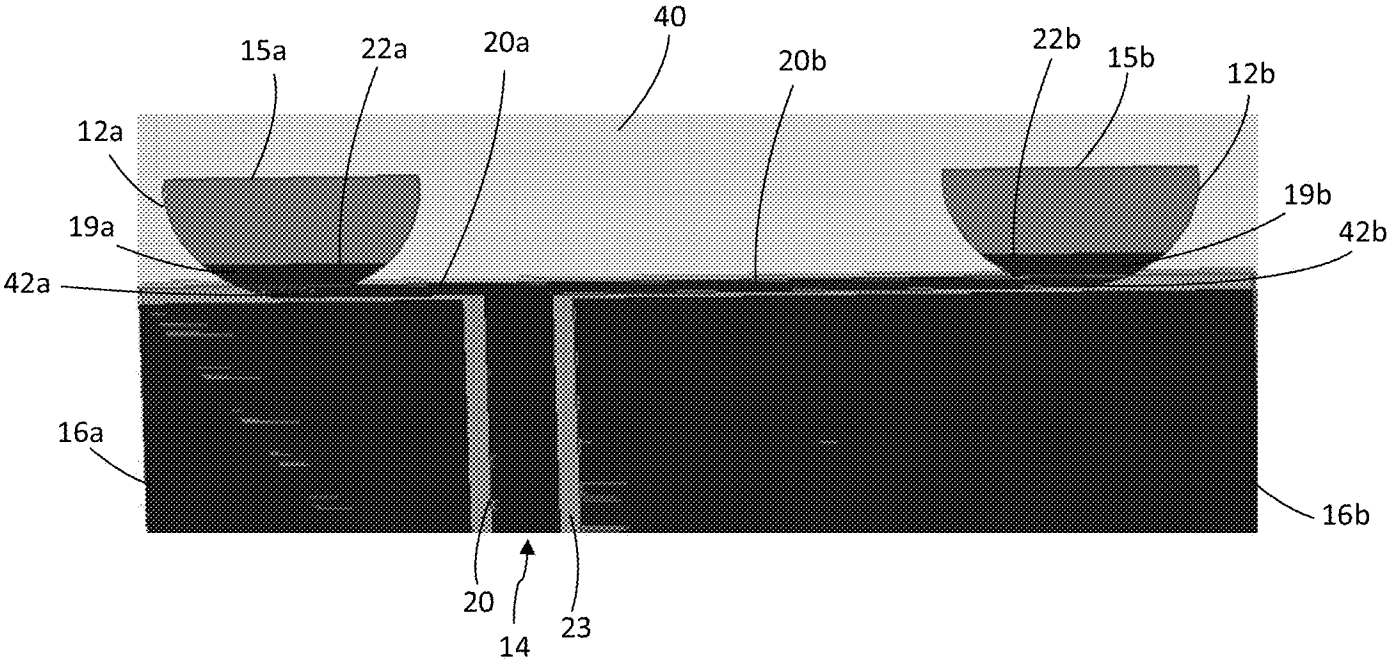
FIG. 4 shows an adaptive feeding system used to feed a two-element semi-elliptical resistive sheet antenna, in accordance with another exemplary embodiment.

FIG. 4 shows another exemplary configuration of an antenna-feeding system in accordance with aspects an embodiment of the present invention, comprising two identical, semi-elliptical antenna elements 12*a* and 12*b*, a coplanar waveguide 14, and two semi-elliptical feeding coupling elements 19*a* and 19*b*. Antenna elements 12*a* and 12*b* are both disposed on top of a 280×174 mm glass substrate 40 of 0.55-mm thickness, having a relative permittivity of 7 and a loss tangent of 0.01. Coplanar waveguide 14 and feeding coupling elements 19*a* and 19*b* are formed by thin layers of conductive material disposed on a rigid or flexible substrate 23, as well known to those skilled in the art.

In this configuration, the ground plane structure of coplanar waveguide 14 is formed by two rectangular thin layers of a conductive material 16*a* and 16*b* having different dimensions with respect to one another, i.e., 10×14 mm and 10×30 mm, respectively. Antenna elements 12*a* and 12*b* are disposed on glass substrate 40 such that midpoints 42*a* and 42*b* along the semi-elliptical edge of antenna elements 12*a* and 12*b*, equidistant from the ends of linear edges 15*a* and 15*b*, respectively, are positioned at the same edge along the width of glass substrate 40. Feeding coupling elements 19*a* and 19*b* overlap antenna elements 12*a* and 12*b*, respectively, such that midpoints 42*a* and 42*b* along the semi-elliptical edge of antenna elements 12*a* and 12*b*, equidistant from the ends of linear edge 15*a* and 15*b*, respectively, are positioned at a distance of approximately 1 mm from linear edges 22*a* and 22*b* of feeding coupling elements 19*a* and 19*b*. The semi-elliptical edge of antenna elements 12*a* and 12*b* is elliptically shaped according to an ellipse with a major axis of approximately 9.2 mm, parallel to linear edge 15*a*, 15*b* and a major-to-minor axes ratio of 1.15.

Additionally, rectangular feed line 20, having dimensions of 3×10.7 mm splits into two rectangular sections 20*a* and 20*b*, with dimensions of 0.5×9.1 mm and 0.5×22.5 mm, respectively, to allow feeding coupling element 19*a*, 19*b* to physically and electrically connect to antenna element 12*a*, 12*b*, respectively. Feed line 20 is generally parallel to, and separated 0.5 mm from, an edge of ground plane sections 16*a* and 16*b*. Likewise, sections 20*a* and 20*b* are generally parallel to, and separated about 0.2 mm from, an edge of ground plane sections 16*a* and 16*b*. A choice of a different length for sections 20*a* and 20*b* of feed line 20 may help in designing an antenna capable of operating at more than one frequency band. The specific frequency bands of operation may be adjusted by varying the lengths of sections 20*a* and 20*b* of feed line 20. In this configuration, a first intended frequency band of operation ranges approximately between 2.2 GHz and 2.5 GHz, and a second intended frequency band of operation ranges about between 5 GHz and 5.8 GHz.

Those skilled in the art will recognize that the configuration shown in FIG. 4 may be implemented with sections 20*a* and 20*b* having the same length. Likewise, ground plane sections 16*a* and 16*b* may have identical dimensions. Additionally, an input impedance performance of antenna elements 12*a* and 12*b* may be modified by varying the separation between sections 20*a* and 20*b* and ground plane sections 16*a* and 16*b*.

Figure 5:
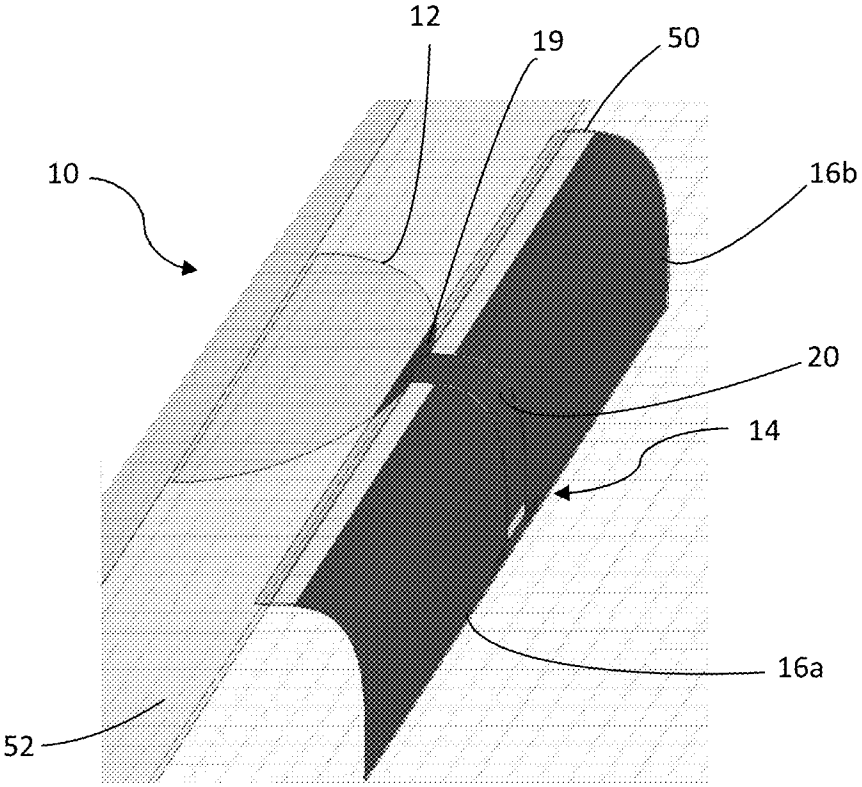
FIG. 5 shows an adaptive feeding system using a coplanar waveguide implemented on a flexible substrate, in accordance with another exemplary embodiment.

In certain applications, the location of antenna element 12 on an electronic device, such as a touchscreen, is strictly limited to a small area on a given layer of such device. The use of a flexible structure such as a flexible printed circuit (FPC) offers an option to reduce the overall size occupied by antenna-feeding system 10 on the space-limited layer of the electronic device. FIG. 5 shows another exemplary configuration in accordance with certain aspects of an embodiment in which a coplanar waveguide feeding is implemented on a flexible substrate 50, such as polyimide, as is well known to those skilled in the art. The ground plane structure 16*a*, 16*b* and feed line 20 of coplanar waveguide 14 as well as feeding coupling element 19 are formed by thin layers of conductive material all disposed on flexible substrate 50 to facilitate a spatial arrangement such that the region of layer 52 occupied by antenna-feeding system 10 is approximately the same area within the perimeter defined by the edges of antenna element 12. In other words, flexible substrate 50 can be bent in a way that only feeding coupling element 19 is disposed on layer 52. Alternatively, antenna element 12 can also be implemented on flexible substrate 50 such that the entire antenna-feeding system 10 is disposed on flexible substrate 50. This may be advantageous for certain applications in terms of antenna performance or a practical, low cost implementation.

Figure 6:
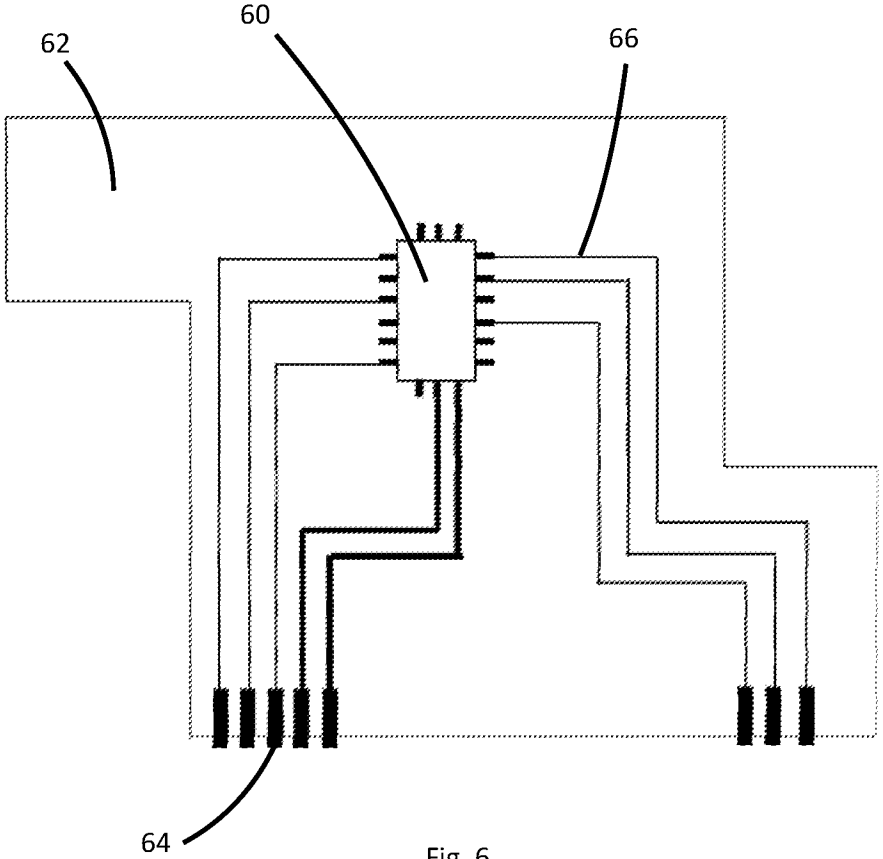
FIG. 6 shows an electronic device implemented on a flexible substrate.

FIG. 6 shows an electronic device 60 implemented on a flexible substrate 62. Likewise, a terminal 64 for electrically connecting to an external electronic device can be implemented on flexible substrate 62 at different locations and in multiple numbers. Furthermore, a conductive trace 66 of selectable length, width, and thickness can be implemented on flexible substrate 62 at different locations and in multiple numbers. Therefore, in another exemplary configuration, the entire antenna-feeding system 10 in addition to a transmission line to electrically connect antenna-feeding system 10 to a radio module or electronic system, including impedance matching circuitry, an amplifier, an RF filter, a receiver, a transmitter, a transceiver (transmitter and receiver) or a signal processing module may also be implemented on flexible substrate 62. Even further, a radio module or electronic system, including impedance matching circuitry, an amplifier, an RF filter, a receiver, a transmitter, a transceiver (transmitter and receiver) or a signal processing module may be implemented on flexible substrate 62 along with antenna-feeding system 10 and one or more transmission lines.

Figure 7:
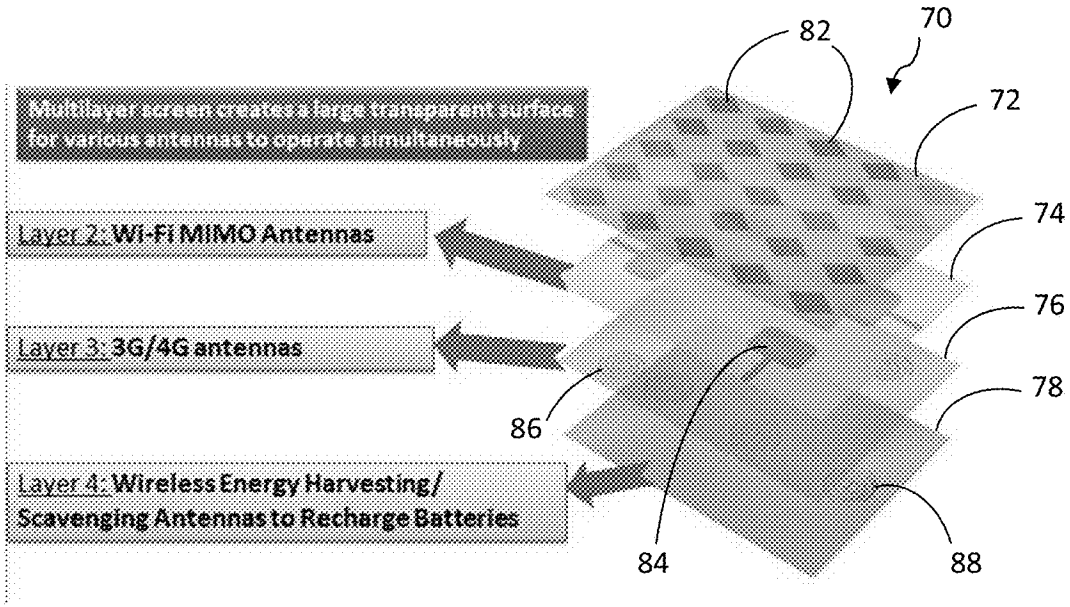
FIG. 7 shows a multilayer structure showing an arrangement of multiple antennas at different layers for various applications.

In yet another exemplary configuration in accordance with certain aspects of an embodiment, FIG. 7 shows a plurality of antennas disposed on a multiple layer structure 70, in which a screen layer 72, such as a touch screen layer implemented on an electronic device, is disposed on top of a first layer 74. Likewise, first layer 74 is disposed on top of a second layer 76, and second layer 76 is disposed on top of a third layer 78. Each of these layers 72, 74, 76, 78 may be made of a flexible or rigid dielectric substrate that may, but does not need to, be the same dielectric substrate used to make any other of said layers. One or more antennas 84 may be disposed on first layer 74. Similarly, one or more antennas 86 and 88 may be disposed on second layer 76 and third layer 78, respectively. Therefore, a plurality of antennas may be disposed on any layer 74, 76, 78 of multilayer structure 70 to operate simultaneously. As a result, one antenna-feeding system 10 may be disposed on any layer of multilayer structure 70. Moreover, one antenna-feeding system 10 may be used to directly feed one antenna and at the same time electromagnetically couple to feed one or more antennas disposed on the same or at a different layer of multilayer structure 70. Alternatively, more than one antenna-feeding system 10 may be used on one or more layers of multilayer structure 70.

Although in the configuration shown in FIG. 7 touch screen layer 72 is positioned above all other layers 74, 76, 78 of multilayer structure 70, those skilled in the art will recognize that other configurations of multilayer structure 70 are possible, specifically wherein touch screen layer 72 is positioned below all other layers 74, 76, 78 or in between any two of said layers.

Each of the antennas 84, 86, 88 can be used for the same or a different application and can be implemented by means of a highly conductive material, such as copper or silver, or a resistive material, such as Indium tin-oxide. FIG. 7 shows only in an illustrative manner some of the potential applications of antennas 84 disposed on layer 74, for instance, Wi-Fi multiple-input multiple-output (MIMO) applications. Similarly, antennas 86, disposed on layer 76, may be used for cellular 3G or 4G applications, and antennas 88, disposed on layer 78 may be used for wireless energy harvesting applications. Those skilled in the art will recognize that many other antenna applications are possible for antennas 84, 86, 88.

Typically, for a touch screen layer 72, an array of touch sensors 82, made of a resistive material, are disposed on and throughout most of the surface of layer 72. Touch sensors 82 may block or obstruct radio signals transmitted or received by antennas 84, 86, 88, resulting in a degradation of performance of said antennas. An option to overcome such performance degradation is to create a geometrical pattern in touch screen layer 72 by rearranging touch sensors 82 or alternatively deleting a portion of the resistive material disposed on touch screen layer 72, such that the performance of touch screen layer 72 is not significantly affected, to implement a frequency selective surface on touch screen layer 72. A properly designed frequency selective surface will allow radio signals transmitted or received by antennas 84, 86, 88 to propagate through layer 72 without severely affecting the performance of the antennas.

In general, each layer 72, 74, 76, 78 is electrically isolated from one another. However, the typical proximity between any two of the layers is on the order of several hundred microns, resulting in a potentially strong electromagnetic coupling between conductive or resistive elements disposed on any of the layers. Therefore, a number, location, distribution, and topology of antennas 84, 86, 88 may depend on each specific application of the antennas, the material used to make the antennas, and the structures surrounding the antennas. Accordingly, one or more antenna-feeding systems may be used on one or more layers of multilayer structure 70.

Those skilled in the art will realize that other methods of implementing feed line 20 are possible. Thus, in addition to using a coplanar waveguide, a microstrip line, a coplanar stripline, a coaxial cable and its associated transition sections to planar structures, a slot, and other types of transmission lines known in the prior art may be used without departing from the spirit and scope of the invention. Likewise, those skilled in the art will recognize that feeding coupling element 19 may be implemented by using conductive adhesive, soldering a conductive terminal, or other types of electromagnetically-coupled feeding elements known in the prior art.

Alternatively, other forms of the configurations described herein may include a resistive sheet antenna having a topology with at least one smooth edge and at least one smooth corner. In another configuration, the topology of the resistive sheet antenna may be configured to reduce electromagnetic coupling to other resistive or conductive materials. In yet another configuration, the topology of the resistive sheet antenna may be configured to have a shape as wide as possible, to have at least one region wide enough to avoid RF current "pinch points." Likewise, in any of the configurations described herein, the antenna-feeding system may operate in an elliptical polarization, including a generally linear polarization and a generally circular polarization; in a single frequency band or multiple frequency bands; and as part of a single, diversity, multiple input multiple output (MIMO), reconfigurable or beam forming network system.

Likewise, those skilled in the art will realize that one or more components described in the different configurations of antenna-feeding system 10 may be implemented by means of a resistive film comprising a metal oxide compound, such as tin oxide, disposed on a flexible or rigid substrate, or by application of a resistive coating directly to a flexible or rigid substrate or to a thin layer of a substrate such as polyethylene terephthalate or polyimide to be disposed on a flexible or rigid substrate.

Figure 8:
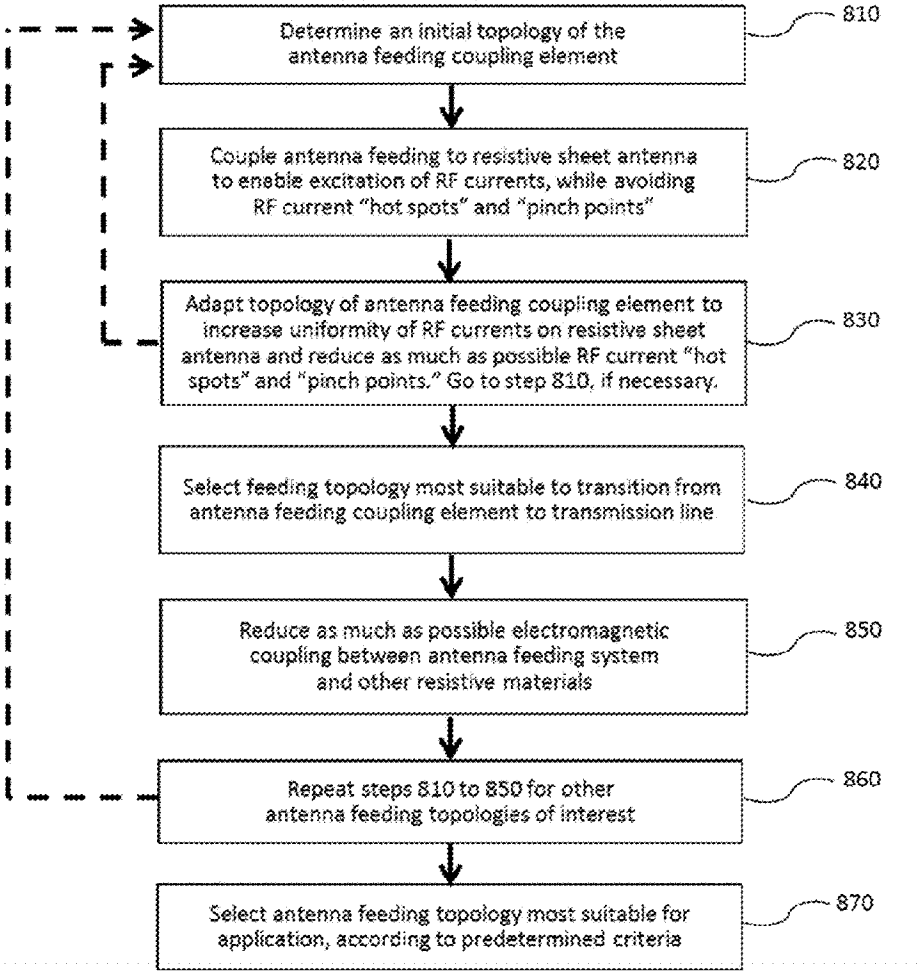
FIG. 8 shows a schematic view of a method for designing an adaptive feeding system to feed a resistive sheet antenna.

Regarding each of the above-described configurations, a method as depicted in FIG. 8 for designing an adaptive feeding topology to feed a resistive sheet antenna, and for setting up the feeding system dimensional and operational parameters, may be performed according to the following:

1. At step 810, determining an initial topology design of the antenna feeding coupling element. In particular, the area of the initial topology of the antenna feeding coupling element, in which the RF currents of interest flow, must be smaller than the area defined by the periphery of the topology of the resistive sheet antenna.

2. Next, at step 820, coupling the antenna feeding coupling element to the resistive sheet antenna to enable the excitation of RF currents, while avoiding RF current "hot spots" and RF current "pinch points," by increasing the uniform distribution of RF currents flowing over the resistive sheet, at the frequencies of interest.

3. Next, at step 830, adapting the topology of the antenna feeding coupling element, through alternative topology designs, to enable the excitation of RF currents that flow as uniformly as possible over the resistive sheet antenna, to reduce RF current "hot spots" and RF current "pinch points." This may include the implementation of one or more of the following design considerations: increasing the coupling area of the feeding coupling element and the resistive sheet antenna wherein the currents flow, reducing the sheet resistivity of the resistive sheet, and smoothing out the edges and avoiding sharp corners of the feeding topology in regions wherein the currents flow.

4. Next, at step 840, selecting the feeding topology most suitable to transition from the antenna feeding coupling element to the transmission line to be used for the intended application of the antenna.

5. Next, at step 850, reducing as much as possible any electromagnetic coupling between the antenna feeding system and other materials within a radius of two wavelengths at the lowest frequency of operation of the antenna in the medium wherein the antenna is intended to operate. This may include reconfiguring the topology of the antenna feeding system.

6. Next at step 860, repeating steps 810 to 850, if necessary, for other topologies of the antenna feeding system.

7. Last, at step 870, selecting the topology of the antenna feeding system most suitable for the intended application of the adaptive feeding-resistive sheet antenna, in terms of performance or other predetermined criteria.

Those of ordinary skill in the art will recognize that the steps above indicated can be correspondingly adjusted for specific configurations and other constraints, including operating frequency band and bandwidth, radiation gain, polarization, radiation efficiency, input impedance matching, operational conditions, surrounding environment, available area and location for implementation of the antenna and adaptive feeding system, method of antenna feeding, and type of transmission line used for a given application.

Preferably, the uniformity of RF currents flowing over the resistive sheet, RF current "hot spots," RF current "pinch points," the electromagnetic coupling between two materials, and other antenna performance parameters, including but not limited to electromagnetic fields, radiation efficiency, currents, radiation gain, input impedance, and polarization are determined by means of a computer-assisted simulation tool and electromagnetic simulation software, such as Ansys-HFSS commercial software or other methods well-known by those skilled in the art.

Most preferably, a data processing and decision making algorithm may be implemented to analyze parameters or calculate a figure of merit of the adaptive feeding system performance, including but not limited to electromagnetic fields, transmission efficiency, radiation efficiency, currents, and input impedance, to support or guide the adaptive antenna feeding design process as described herein, as those skilled in the art will realize. Alternatively, a figure of merit of the antenna performance, including but not limited to electromagnetic fields, radiation efficiency, currents, radiation gain, input impedance, and polarization, may be determined to support or guide the adaptive antenna feeding design process as described herein, as those skilled in the art will realize.

The various embodiments have been described herein in an illustrative manner, and it is to be understood that the terminology used is intended to be in the nature of words of description rather than of limitation. Any embodiment herein disclosed may include one or more aspects of the other embodiments. The exemplary embodiments were described to explain some of the principles of the present invention so that others skilled in the art may practice the invention. Obviously, many modifications and variations of the invention are possible in light of the above teachings. The present invention may be practiced otherwise than as specifically described within the scope of the appended claims and their legal equivalents.

We claim:

1. A feeding system to feed an antenna element, comprising:

an antenna element;

a feeding coupling element attached to said antenna element; and a transmission line coupled to said feeding coupling element;

wherein said feeding coupling element has a topology defining a first peripheral boundary enclosing an area of said feeding coupling element, wherein said antenna element comprises a resistive layer comprising a metal compound such that said resistive layer is partly electrically conductive, wherein said antenna element has a topology defining a second peripheral boundary enclosing an area of said resistive layer, wherein said topology of said feeding coupling element has at least one edge having a smooth configuration and a shape according to an elliptical function, and wherein said topology of said feeding coupling element is adapted to said topology of said antenna element to reduce a plurality of losses caused by a current density flowing within said area of said resistive layer, by a sufficient extent so as to enable said antenna element to radiate an electromagnetic signal with a radiation efficiency of between approximately 10% and 90%; and wherein said topology of said feeding coupling element is configured such that an input impedance at said feeding coupling element substantially matches an input impedance of said transmission line coupled to said feeding coupling element.

2. The feeding system of claim 1, wherein said feeding coupling element is adapted to be conformal to at least a portion of said area of said antenna element.

3. The feeding system of claim 1, wherein said peripheral boundary of said topology of said feeding coupling element forms a shape that prevents radiofrequency current from converging to create a localized high current concentration on said resistive layer.

4. The feeding system of claim 1, wherein said feeding coupling element comprises a resistive layer.

5. The feeding system of claim 1, wherein a portion of said area of said resistive layer in which said current density flows is larger than said area of said feeding coupling element.

6. The feeding system of claim 1, wherein a portion of said area of said antenna element overlaps a portion of said area of said feeding coupling element.

7. The feeding system of claim 1, further comprising a substantially non-conductive substrate, wherein said feeding system is at least partly disposed on said substrate.

8. The feeding system of claim 7, wherein said substrate is substantially flexible.

9. The feeding system of claim 7, wherein at least one electronic component is mounted on said substrate.

10. The feeding system of claim 7, further comprising a plurality of substantially non-conductive substrates, wherein said feeding coupling element is coupled to a plurality of antennas disposed on said plurality of substrates.

11. The feeding system of claim 1, wherein said feeding coupling element is adapted to transition from a configuration of said transmission line to said topology of said antenna element.

12. The feeding system of claim 1, wherein said transmission line is formed by a plurality of transmission line sections that couple to a plurality of said feeding coupling elements to feed a plurality of said antenna elements.

13. The feeding system of claim 1, wherein said feeding coupling element is electromagnetically coupled to said antenna element.

14. The feeding system of claim 1, wherein said feeding coupling element is part of a touchscreen.

15. The feeding system of claim 1, wherein said resistive layer has a sheet resistivity of between 5 and 100 Ohms per square.

16. A method for designing an adaptive feeding topology to feed an antenna element, comprising:

a. providing a feeding system, further comprising:

an antenna element;

a feeding coupling element attached to said antenna element; and a transmission line coupled to said feeding element;

wherein said feeding coupling element has a topology defining a first peripheral boundary enclosing an area of said feeding coupling element, wherein said antenna element comprises a resistive layer comprising a metal compound such that said resistive layer is partly electrically conductive, wherein said antenna element has a topology defining a second peripheral boundary enclosing an area of said resistive layer, wherein said topology of said feeding coupling element has at least one edge having a smooth configuration and a shape according to an elliptical function, and wherein said topology of said feeding coupling element is adapted to said topology of said antenna element to reduce a plurality of losses caused by a current density flowing within said area of said resistive layer, by a sufficient extent so as to enable said antenna element to radiate an electromagnetic signal with a radiation efficiency of between approximately 10% and 90%; and wherein said topology of said feeding coupling element is configured such that an input impedance at said feeding coupling element substantially matches an input impedance of said transmission line coupled to said feeding coupling element;

b. determining an initial topology design of said antenna feeding coupling element, wherein the area of said initial topology of said antenna feeding coupling element, in which a radiofrequency of interest flows, is smaller than said area of said resistive layer, and wherein said feeding coupling element enables an excitation of a radiofrequency current, while preventing the convergence of said radiofrequency current to create one or more regions of localized high current concentration on said resistive layer;

c. designing an alternative topology of said feeding coupling element to enable the excitation of a radiofrequency current that increases a uniform distribution of said current density flowing within said area of said resistive layer; and d. selecting a most suitable design of said topology of said feeding coupling element to transition from said topology of said antenna element to said transmission line.

17. The method of claim 16, wherein said step of designing an alternative topology further comprises the step of reducing an existing electromagnetic coupling between said feeding system and a different material.

18. The method of claim 16, further comprising the steps of designing a plurality of alternative designs of said topology of said feeding system, and selecting a most suitable design of said topology of said feeding system from said plurality of alternative designs for an application, according to a predetermined criteria.

* * * * *